United States Patent [19]

Laffter et al.

[11] Patent Number: 4,779,583

[45] Date of Patent: Oct. 25, 1988

[54] CUP-TYPE TAPPETS FOR USE IN INTERNAL COMBUSTION ENGINES

[75] Inventors: Alfred Laffter, Laudenbach; Erich Neuthard, Hemsbach; Klaus Schlag, Birkenau; Helmut Schluter, Reichelsheim, all of Fed. Rep. of Germany

[73] Assignee: Firma Carl Freudenberg, Weinheim, Fed. Rep. of Germany

[21] Appl. No.: 946,310

[22] Filed: Dec. 24, 1986

[30] Foreign Application Priority Data

May 27, 1986 [DE] Fed. Rep. of Germany ..... 3617858

[51] Int. Cl.[4] ..... F01L 1/24

[52] U.S. Cl. ..... 123/90.58; 123/90.55

[58] Field of Search ..... 123/90.58, 90.55, 90.48, 123/90.57, 90.59

[56] References Cited

U.S. PATENT DOCUMENTS

| | | | |
|---|---|---|---|
| 4,610,225 | 9/1986 | Comosso et al. | 123/90.58 |
| 4,632,075 | 12/1986 | Comosso et al. | 123/90.55 |
| 4,649,875 | 3/1987 | Mirone et al. | 123/90.58 |
| 4,656,978 | 4/1987 | Deuring | 123/90.58 |

FOREIGN PATENT DOCUMENTS

| | | | |
|---|---|---|---|
| 504132 | 7/1954 | Canada | 123/90.58 |
| 196418 | 10/1986 | European Pat. Off. | 123/90.55 |
| 3347670 | 7/1985 | Fed. Rep. of Germany | 123/90.58 |
| 3506730 | 4/1986 | Fed. Rep. of Germany | 123/90.55 |

*Primary Examiner*—Willis R. Wolfe, Jr.
*Assistant Examiner*—M. Macy
*Attorney, Agent, or Firm*—Kenyon & Kenyon

[57] ABSTRACT

A piston-cylinder cup-type tappet for an internal combustion engine comprises an outer housing defining a first cavity and a hollow piston having a second cavity with the hollow piston being disposed in the first cavity. An aperture provides for fluid flow between the first and second cavities. An inner housing is disposed in the first cavity with the inner housing defining a third cavity. The piston is received in the third cavity of the inner housing wherein the piston and the inner housing jointly define a throttle gap. A compression spring is disposed in the third cavity and supports the hollow piston and the inner housing. A check valve is disposed between the second and third cavities and permits fluid flow from the second cavity to the third cavity. A chamber is defined by the first cavity, the second cavity, the third cavity, the aperture and the throttle gap. An incompressible fluid fills this chamber. The chamber is closed off from the exterior thereof by a fluid impermeable wall and at least a portion of this wall adjacent the first cavity is designed as an elastically resilient spring bellows.

12 Claims, 1 Drawing Sheet

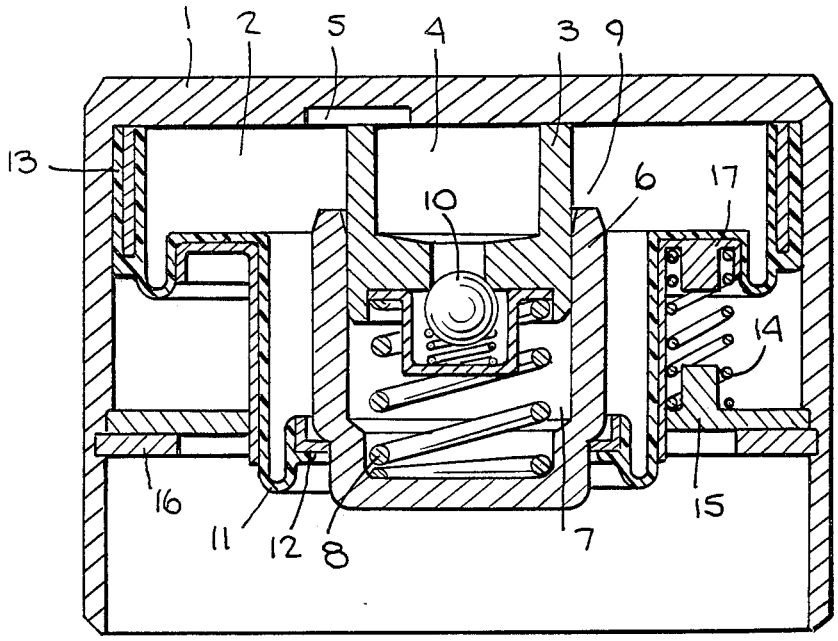
1
2
5
4
3
9
13
10
6
17
14
16
11
12
8
7
15

CUP-TYPE TAPPETS FOR USE IN INTERNAL COMBUSTION ENGINES

FIELD OF THE INVENTION

This invention relates to cup-type tappets for use in an internal combustion engine. More particularly, this invention relates to piston/cylinder cup-type tappets disposed between the upper end of the valves of an internal combustion engine and the camshaft of the engine.

BACKGROUND OF THE INVENTION

Cup-type tappets for use in internal combustion engines are known in the art. They serve to provide automatic valve play compensation between the upper end of internal combustion engine valves and the camshaft. They comprise a piston/cylinder unit which is disposed in the loading direction of the respective valve and into which oil from the oil pressure circulating lubrication system is fed. This causes the piston/cylinder unit to extend to a length corresponding to the distance between the upper end of the closed engine valve and the camshaft when the cam is under no load. Leakage fluid leaves the piston/cylinder unit constantly in defined quantities through throttle gaps specially provided for this purpose. The brief loading of the cup-type tappet by the cam during the valve actuation is incapable of significantly changing the length of the piston/cylinder unit. Therefore, reliable closing of the valves is assured at all times independent of possibly occurring wear. However, in the prior art, the clatter noises occurring when starting the engine leaves much to be desired and can lead to engine damage.

OBJECTS OF THE INVENTION

It is an object of the present invention to provide an improved cup-type tappet of the piston/cylinder type so that the clatter noises no longer occur when starting the engine.

These and other objects of the present invention will be apparent from the following description and claims in conjunction with the drawing.

SUMMARY OF THE INVENTION

According to the present invention, this problem is solved by providing a cup-type tappet with a chamber which is closed off to the outside by a limiting through-wall impermeable to fluids and wherein at least a partial area of the limiting through-wall adjoining the first cavity of the chamber is designed as an elastically resilient spring bellows.

The chamber of the cup-type tappet, according to the present invention, is filled with a defined amount of a fluid and closed off to the outside. Therefore, when the engine is shut off, immediate operating readiness of the cup-type tappet is always assured at the time of a new engine start. Clatter noises at engine start-up no longer occur.

According to an advantageous embodiment of the present invention, the cup-type tappet is provided with an outer housing, a hollow piston, and an inner housing having one common axis. The spring bellows is bounded by an elastically supported ring diaphragm, and the ring diaphragm connects the inner and outer housings in sealing fashion. The diameter of the ring diaphragm is greater than that of the inner housing, resulting in only a minimal deformation of the ring diaphragm in the case of an axial displacement of the ring diaphragm. Consequently, the operating life resulting therefrom is considerable.

With a reduction of the material specific loading in mind, the ring diaphragm may be designed as a roll diaphragm. The roll diaphragm advantageously rests on a supporting cage of circular shape with the supporting cage being mounted on supporting springs evenly distributed around the circumference and supported by the outer housing. This assures that the third cavity of the inner housing of the tappet is filled particularly fast from the second cavity of the hollow piston through a check valve inserted between them. When starting the internal combustion engine, this assures that even the engine valves which were subjected to the action of a cam during the preceding shut down of the engine are immediately correctly actuated.

The supporting cage may be of U-shaped section with the legs of the section projecting, at least partially, into the zone intermediate between the supporting springs and the roll diaphragm. This reduces decisively the danger of the supporting springs damaging the roll diaphragm.

Advantageously, the supporting springs are designed as spiral or helical springs having axes disposed parallel to the direction of motion of the inner housing. This assures a particularly long operating life and good functional reliability while keeping the design of the cup-type tappet of the invention simple.

In the areas in contact with the inner and outer housings, the ring diaphragm may be reinforced by stiffening rings of metallic or plastic material. Its assembly, and hence the production of the functional unit, is made particularly simple by such a feature. The present invention is explained below in greater detail with reference to the annexed drawing.

BRIEF DESCRIPTION OF THE DRAWING

The single FIGURE of the drawing illustrates a vertical cross-sectional view of a cup-type tappet in accordance with one embodiment of the present invention.

DETAILED DESCRIPTION

The cup-type tappet in accordance with one embodiment of the present invention and illustrated in the drawing serves to provide the automatic valve play compensation between the inlet and the outlet valves of an internal combustion engine and the camshaft providing the valve actuation. Accordingly, the cup-type tappet is advantageously disposed between the upper end of a respective valve and the camshaft with a mutual congruence between its axis and the direction of the dynamic effect.

The cup-type tappet comprises the outer housing 1 providing the first cavity 2 and a hollow piston 3 disposed in the first cavity. The hollow piston 3 has a second cavity 4. An aperture 5 provides fluid communication between the first and second cavities. An inner housing 6 is disposed on and receives the hollow piston 3 in a third cavity 7 with the hollow piston 3 and the inner housing 6 supporting each other through a compression spring 8. The inner peripheral side wall of the inner housing 6 and the outer pheriphal side wall of the piston 3 delimit jointly an annular throttle gap 9. A check valve 10 is disposed between the second and third cavities 4, 7 for passing fluid from the second cavity 4 to the third cavity 7. A chamber is enclosed and defined jointly by the aperture 5, the throttle gap 9, the first cavity 2 of the outer housing 1, the third cavity 7 of the inner housing 6, and the second cavity 4 of the hollow piston 3. This chamber is filled completely with incompressible fluid such as a lubrication oil.

The chamber is closed off to the outside by a through limiting wall impermeable to fluids with the limiting wall being formed in the annular gap between the outside of the inner housing 6 and the inside of the outer housing 1 by a resilient spring bellows. Advantageously, the spring bellows has the shape of a circular roll diaphragm 11 of textile-reinforced rubber provided in the area of its inner and outer periphery with metal rings 12, 13 which fix it in sealing fashion to the inner housing 6 on the one hand and to the outer housing 1 on the other. In the intermediate zone between both metal rings 12, 13, the roll diaphragm 11 is mounted on an annular supporting cage 17 of U-shaped profile which opens towards the bottom of the cup-type tappet. The supporting cage 17 may be formed from a metal or plastic material and may itself be a spring element. If the supporting cage 17 is formed from a plastic material, this plastic material may be reinforced by reinforcing elements. The supporting cage 17 is in contact with the underside of the roll diaphragm 11 and is advantageously engaged by three supporting springs 14 evenly distributed around the circumference thereof. The bottom ends of the supporting springs 14 are mounted on a supporting ring 15 which is kept axially immovable in the outer housing 1 by a snap ring 16. By matching the outside diameter of the supporting ring 15 to the inside diameter of the outer housing 1, a precise mutual coordination in radial direction is assured. The supporting ring 15 is thereby enabled to impart to the supporting cage 17 and, hence, to the roll diaphragm 11 at the same time, good guidance in the event of axial displacements.

The operation of the illustrated embodiment of the cup-type tappet of the present invention is now described. In the cup-type tappet illustrated in the drawing, the chamber jointly defined by the first cavity 2, the aperture 5, the second cavity 4, the third cavity 7 and the throttle gap 9 is completely filled with incompressible fluid. The spring elasticity of the compression spring 8 is weaker than that of the closing spring of the associated engine valve and, with respect to the fluid contained in the chamber, of the same dynamic direction as the spring elasticity of the supporting springs 14. If the engine valve (not illustrated) is not actuated, the third cavity 7 of the inner housing 6 will reach its maximum filled volume with the top side of the outer housing 1 contacting with low pressure the underside of the engine camshaft (not illustrated). The bottom of the inner housing 6 with equal pressure contacts the upper end of the associated engine valve (not illustrated). The engine valve is firmly closed due to the action of its closing spring.

When the camshaft cam engages the top side of housing 1 as the camshaft continues to turn, a pressure is caused to build up in the fluid inside the third cavity 7 which thus causes leaking fluid to pass from cavity 7 through the throttle gap 9 into the first cavity 2 of the outer housing 1 to be stored therein. Due to the short time span during which the cam is active under normal engine operating conditions, this fluid loss from third cavity 7 to first cavity 2 does not lead to a significant reduction of the fluid volume contained in the third cavity 7 so that the original support length provided by the cup-type tappet between the upper end of the associated engine valve and the camshaft remains essentially unchanged. Accordingly, the valve is displaced and this displacement substantially coincides with the eccentricity of the cam. The force of the engine valve closing spring has no further significance during displacement due to the eccentricity of the cam.

As the camshaft continues to turn, the cam disengages, which leads to the valve including the cup-type tappet being returned into the initial position by the force of the valve closing spring. The valve travel is restricted by the valve striking its valve seat, resulting first in a certain play between the camshaft and the upper end of the valve. The force of the compression spring 8 now becomes effective again and causes the inner housing 6 and the hollow piston 3 to move apart in axial direction of the cup-type tappet. This causes the fluid volume displaced during the work cycle from the third cavity 7 through the throttle gap 9 into the first cavity 2 to flow back through the aperture 5, the second cavity 4 and the check valve 10 into the third cavity 7. This re-establishes the original operating condition. This process is further accelerated by the force of the supporting springs 14.

If the engine stops while one of the cams present is engaged, this will lead to a gradual, corresponding emptying of the third cavity 7 via the throttle gap 9 into the first cavity 2. If due to the subsequent restarting of the internal combustion engine a greater distance between the upper end of this engine valve and the camshaft results, the consequence thereof will be an immediate moving apart of the inner housing 6 and the hollow piston 3 in axial direction of the cup-type tappet due to the force of the compression spring 8 and the simultaneous filling of the third cavity 7 assisted by supporting springs 14. Due to the action of the supporting springs 14, cavitation phenomena are impossible, even if the camshaft revolves rapidly, and an immediate operating readiness of the cup-type tappet is attained. Therefore, the first subsequent engagement of the cam with the top side of the outer housing 1 already results in a correct engine valve actuation. Clatter noises and possible damage to the engine are therefore reliably avoided by the cup-type tappet in accordance with the present invention.

Although preferred embodiments of the present invention have been described in detail, it will be appreciated that modifications may be made by those skilled in the art all within the spirit and the scope of the present invention as defined in the claims.

What is claimed is:

1. In a cup-type tappet for an internal combustion engine comprising:

an outer housing defining a first cavity in the interior thereof;

a piston having an outer peripheral sidewall, said piston being disposed in said first cavity and having a second cavity formed in the interior thereof;

aperture means for providing fluid flow between said first cavity and said second cavity;

an inner housing having an inner peripheral sidewall defining a third cavity within said inner housing, said inner housing being disposed in said first cavity and with said third cavity of said inner housing receiving said piston for movement therein, wherein the outer peripheral sidewall of said piston and the inner peripheral sidewall of said inner housing jointly define a throttle gap therebetween;

said outer housing having an inner wall and said inner housing having an outer wall defining an annular gap therebetween;

a compression spring disposed in said third cavity supporting said piston and said inner housing and resisting movement of said piston into said third cavity;

check valve means disposed between said second cavity and third cavity for permitting fluid flow from said second cavity to said third cavity;

wherein said first cavity, said second cavity, said third cavity, said aperture means, and said throttle gap jointly define a chamber; and an incompressible fluid completely filling said chamber;

the improvement comprising:

wall means impermeable to fluids closing off said chamber from fluid communication with the exterior thereof;

said wall means comprising a ring diaphragm disposed in said annular gap and connecting said inner and outer housings in a sealing manner, said ring diaphragm having one side facing away from said chamber;

an annular supporting cage disposed in said annular gap with said one side of said ring diaphragm facing away from said chamber resting on said supporting cage; and spring means for elastically pressing said supporting cage against said ring diaphragm.

2. A cup-type tappet according to claim 1 wherein said ring diaphragm is a rolled diaphragm.

3. A cup-type tappet according to claim 2 wherein said annular supporting cage is mounted on said spring means and said spring means comprises a plurality of springs supported by said outer housing and evenly distributed around the circumference of said annular supporting cage.

4. A cup-type tappet according to claim 3 wherein said spring means comprises three springs.

5. A cup-type tappet according to claim 3 wherein said supporting cage has a U-shaped cross-section with one leg of said U at least partially extending between said springs and said rolled diaphragm.

6. A cup-type tappet according to claim 3 wherein said springs are helical springs disposed parallel to said common axis of said outer housing, said inner housing and said piston.

7. A cup-shaped tappet according to claim 1 wherein said supporting cage is formed by a spring element.

8. A cup-shaped tappet according to claim 1 wherein said supporting cage is formed from a plastic material.

9. A cup-shaped tappet according to claim 8 wherein said plastic material is reinforced by reinforcing elements.

10. A cup-shaped tappet according to claim 1 wherein stiffening rings are provided in said ring diaphragm in the regions thereof contacting said inner and said outer housings.

11. A cup-shaped tappet according to claim 10 wherein said stiffening rings are a metallic material.

12. A cup-shaped tappet according to claim 10 wherein said stiffening rings are a plastic material.

* * * * *